US005697987A

United States Patent [19]

Paul

[11] Patent Number: 5,697,987

[45] Date of Patent: Dec. 16, 1997

[54] ALTERNATIVE FUEL

[75] Inventor: Stephen F. Paul, Princeton, N.J.

[73] Assignee: The Trustees of Princeton University, Princetion, N.J.

[21] Appl. No.: 644,907

[22] Filed: May 10, 1996

[51] Int. Cl.[6] ..... C10L 1/18; C10L 1/16

[52] U.S. Cl. ..... 44/352; 44/451

[58] Field of Search ..... 44/350, 352, 446, 44/451

[56] References Cited

U.S. PATENT DOCUMENTS

| | | | |
|---|---|---|---|
| 2,104,021 | 1/1938 | Callis | 44/446 |
| 2,321,311 | 6/1943 | Mottlau | 44/352 |
| 2,725,344 | 11/1955 | Fenske et al. | 44/352 |
| 3,857,859 | 12/1974 | Tumolo . | |
| 3,909,216 | 9/1975 | Stearns et al. | 44/352 |
| 4,191,536 | 3/1980 | Nielylski | 44/352 |
| 4,207,077 | 6/1980 | Bone et al. | 44/446 |
| 4,603,662 | 8/1986 | Norton et al. | 44/352 |
| 4,806,129 | 2/1989 | Dorn et al. . | |
| 4,897,497 | 1/1990 | Fitzpatrick . | |
| 5,004,850 | 4/1991 | Wilson . | |
| 5,093,533 | 3/1992 | Wilson . | |
| 5,515,280 | 5/1996 | Suzuki | 44/352 |

FOREIGN PATENT DOCUMENTS 30 16 481 A 11/1981 Germany .

OTHER PUBLICATIONS

Fitzpatrick, "MTHF: A Important New Development for Reformulated Gasoline." Date Unknown.

Fitzpatrick, "Ethanol Market Development Challenges—New Feedstocks and Formulations," *Governors' Ethanol Coalition Presentation*, Feb. 16, 1995.

Lucas et al., *SAE Tech. Paper Ser. No. 932,675* (Oct. 18, 1993).

Rudolph et al., *Biomass*, 16, 33–49 (1988). Month unknown.

Wallington et al., *Environ. Sci. Technol.*, 24, 1596–99 (1990). Month unknown.

Thomas et al., "Biomass Derived Levulinic Acid Derivatives and Their Use as Liquid Fuel Extenders," *Biomass Energy Dev.* [*Proc. South. Biomass Energy Res. Conf.* ], *3rd* (Smith, Editor; Plenum, New York; 1986) 333–48 (1985 Meeting date) Month Unknown.

*Primary Examiner*—Margaret Medley

*Attorney, Agent, or Firm*—Lerner, David, Littenberg, Krumholz & Mentlik

[57] ABSTRACT

A spark ignition motor fuel composition consisting essentially of: a hydrocarbon component containing one or more hydrocarbons selected from five to eight carbon atoms straight-chained or branched alkanes essentially free of olefins, aromatics, benzene and sulfur, wherein the hydrocarbon component has a minimum anti-knock index of 65 as measured by ASTM D-2699 and D-2700 and a maximum DVPE of 15 psi as measured by ASTM D-5191; a fuel grade alcohol; and a co-solvent for the hydrocarbon component and the fuel grade alcohol; wherein the hydrocarbon component, the fuel grade alcohol and the co-solvent are present in amounts selected to provide a motor fuel with a minimum anti-knock index of 87 as measured by ASTM D-2699 and D-2700, and a maximum DVPE of 15 psi as measured by ASTM D-5191. A method for lowering the vapor pressure of a hydrocarbon-alcohol blend by adding a co-solvent for the hydrocarbon and the alcohol to the blend is also disclosed.

16 Claims, No Drawings

ALTERNATIVE FUEL

BACKGROUND OF THE INVENTION

The present invention relates to spark ignition motor fuel compositions based on liquid hydrocarbons derived from biogenic gases that are blended with a fuel grade alcohol and a co-solvent for the liquid hydrocarbon and the alcohol, and having an anti-knock index, a heat content, and a Dry Vapor Pressure Equivalent (DVPE) effective to fuel a spark ignition internal combustion engine with minor modifications. In particular, the present invention relates to Coal Gas Liquid (CGL) or Natural Gas Liquids (NGL's)-ethanol blends in which the co-solvent is biomass-derived 2-methyltetrahydrofuran (MTHF).

A need exists for alternatives to gasoline motor fuels for spark ignition internal combustion engines. Gasoline is derived from the extracting of crude oil from oil reservoirs. Crude oil is a mixture of hydrocarbons that exist in liquid phase in underground reservoirs and remains liquid at atmospheric pressure. The refining of crude oil to create conventional gasoline involves the distillation and separation of crude oil components, gasoline being the light naptha component.

Only 10 percent of the world reserves of crude oil lie in the United States, with an overwhelming majority of the remaining 90 percent located outside the boundaries, not only of the United States, but also its North American free trade partners. Over 50 percent of conventional gasoline is imported, with this number to increase steadily into the next century.

Conventional gasoline is a complex composite of over 300 chemicals, including napthas, olefins, alkenes, aromatics and other relatively volatile hydrocarbons, with or without small quantities of additives blended for use in spark ignition engines. The amount of benzene in regular gasoline can range up to 3–5 percent, and the amount of sulfur to 500 ppm. Reformulated gasoline (RFG) limits the quantity of sulfur to 330 ppm and benzene to 1 percent, and limits the levels of other toxic chemicals as well.

Conventional alternatives to crude oil-derived fuels such as compressed natural gas, propane and electricity require large investments in automobile modification and fuel delivery infrastructure, not to mention technological development. A need exists for an alternative fuel that provides the combustion properties of motor gasoline without requiring significant engine modification, and that can be stored and delivered like motor gasoline. In order to be an advantageous alternative for gaseous alternative fuels such as methane and propane, liquid alternative fuels should also meet all Environmental Protection Agency (EPA) requirements for "clean fuels."

CGL and NGL's have unsuitably low anti-knock indexes and have thus been under-utilized as alternatives to crude oil as hydrocarbon sources for spark ignition engine motor fuels. Attempts to overcome this deficiency have rendered these hydrocarbon streams unsuitable for use as alternative fuels.

Coal gases have long been recognized because of explosions that have occurred in the course of coal mining. This gas is considered a hazard to operations and has been vented to insure safe operation. However, such venting contributes to the increasing amounts of atmospheric methane, which is a potent greenhouse gas. C. M. Boyer, et al., *U.S. EPA, Air and Radiation* (*ANR*-445) EPA/400/9-90/008. Coal gases can contain significant amounts of heavier hydrocarbons, with $C_{2+}$ fractions as high as 70 percent. Rice, *Hydrocarbons from Coal* (American Association of Petroleum Geologists, Studies in Geology #38, 1993) p. 159.

In contrast to the sourcing of conventional gasoline, over 70 percent of the world reserves of NGL's lie in North America. Imports of NGL's into the United States constitutes less than 10 percent of domestic production. NGL's are recovered from natural gas, gas processing plants, and in some situations, from natural gas field facilities. NGL's extracted by fractionators are also included within the definition of NGL's. NGL's are defined according to the published specifications of the Gas Processors Association and the American Society for Testing and Materials (ASTM). The components of NGL's are classified according to carbon chain length as follows: ethane, propane, n-butane, isobutane and "pentanes plus."

Pentanes-plus is defined by the Gas Processors Association and the ASTM as including a mixture of hydrocarbons, mostly pentanes and heavier, extracted from natural gas and including isopentane, natural gasoline, and plant condensates. Pentanes-plus are among the lowest value NGL's. While propanes and butanes are sold to the chemical industry, pentanes-plus are typically diverted to low-added-value oil refinery streams to produce gasoline. Part of the reason why pentanes plus are not generally desirable as gasoline is because they have a low anti-knock index that detracts from its performance as a spark ignition engine motor fuel, as well as a high DVPE which would result in engine vapor lock in warm weather. One advantage of pentanes plus over the other NGL's is that it is liquid at room temperature. Therefore is the only component that can be used in useful quantities as a spark ignition engine motor fuel without significant engine or fuel tank modification.

U.S. Pat. No. 5,004,850 discloses an NGL's-based motor fuel for spark ignition engines in which natural gasoline is blended with toluene to provide a motor fuel with satisfactory anti-knock index and vapor pressure. However, toluene is an expensive, crude oil-derived aromatic hydrocarbon. It's use is severely restricted under the reformulated fuel provision of the 1990 Clean Air Act Amendments.

The United States is the world's largest producer of fuel alcohol, with less than 10 percent of ethanol imported. Ethanol is a biomass-derived, octane-increasing motor fuel additive. While ethanol alone has a low vapor pressure, when blended alone with hydrocarbons, the resulting mixture has an unacceptably high rate of evaporation to be used in EPA designated ozone non-attainment areas, which include most major metropolitan areas in the United States. The vapor pressure properties of ethanol do not predominate in a blend with pentanes plus until the ethanol level exceeds 60 percent by volume. However, blends containing such a high level of ethanol are costly and difficult to start in cold weather because of the high heat of vaporization of ethanol. Furthermore, ethanol has a low heat content, resulting in low fuel economy compared to gasoline.

Low-cost production of MTHF and the production and use of biomass-derived materials such as ethanol or MTHF as gasoline extenders at levels up to about 10 percent by volume is disclosed by Wallington et al., *Environ. Sci. Technol.*, 24, 1596–99 (1990); Rudolph et al., *Biomass*, 16, 33–49 (1988); and Lucas et al., *SAE Technical Paper Series, No.* 932675 (1993). Low-cost production of MTHF and it's suitability as a low-octane oxygenate for addition to gasoline with or without ethanol to produce an oxygenated motor fuel was disclosed in an unpublished presentation to the Governors' Ethanol Coalition by Stephen W. Fitzpatrick, Ph.D., of Biofine, Inc. on Feb. 16, 1995. Accurate technical data involving the blending DVPE and blending octane values for MTHF were not available. There remains a need for a motor fuel having a DVPE and anti-knock index suitable for use in a spark ignition internal combustion engine without significant modification obtained from non-crude oil sources.

SUMMARY OF THE INVENTION

This need is met by the present invention. Co-solvents for CGL, and for NGL's hydrocarbons such as natural gasoline or pentanes plus, and motor fuel alcohols such as ethanol have been discovered that result in a blend having the requisite DVPE and anti-knock index for use in a conventional spark ignition engine with minor modifications.

Therefore, in accordance with the present invention, a spark ignition motor fuel composition is provided consisting essentially of:

a hydrocarbon component consisting essentially of one or more hydrocarbons selected from five to eight carbon atom straight-chained or branched alkanes essentially free of olefins, aromatics, benzene and sulfur, wherein the hydrocarbon component has a minimum anti-knock index of 65 as measured by ASTM D-2699 and D-2700 and a maximum DVPE of 15 psi as measured by ASTM D-5191;

a fuel grade alcohol; and a co-solvent for the hydrocarbon component and the fuel grade alcohol;

wherein the hydrocarbon component, the fuel grade alcohol and the co-solvent are present in amounts selected to provide a motor fuel with a minimum anti-knock index of 87 as measured by ASTM D-2699 and D-2700, and a maximum DVPE of 15 psi as measured by ASTM D-5191.

Motor fuel compositions in accordance with the present invention may optionally contain n-butane in an amount effective to provide the blend with a DVPE between about 12 and about 15 psi as measured by ASTM D-5191. The n-butane is preferably obtained from NGL's and CGL.

Another embodiment of the present invention provides a method for lowering the vapor pressure of a hydrocarbon-alcohol blend. Methods in accordance with this embodiment of the present invention blend a motor fuel grade alcohol and one or more hydrocarbons obtained from Natural Gas Liquids with an amount of a co-solvent for the alcohol and the hydrocarbons so that a ternary blend is obtained having a DVPE as measured by ASTM D-5191 lower than the DVPE for a binary blend of the alcohol and the hydrocarbons.

The co-solvent for the hydrocarbon component and the fuel grade alcohol in both the fuel compositions and methods of the present invention is preferably derived from waste cellulosic biomass materials such as corn husks, corn cobs, straw, oat/rice hulls, sugar cane stocks, low-grade waste paper, paper mill waste sludge, wood wastes, and the like. Co-solvents capable of being derived from waste cellulosic matter include MTHF and other heterocylical ethers such as pyrans and oxepans. MTHF is particularly preferred because it can be produced in high yield at low cost with bulk availability, and possesses the requisite miscibility with hydrocarbons and alcohols, boiling point, flash point and density.

Fuel compositions in accordance with the present invention thus may be derived primarily from renewable, domestically-produced, low cost waste biomass materials such as ethanol and MTHF in combination with hydrocarbon condensates otherwise considered extraction losses of domestic natural gas production such as pentanes plus, and are substantially free of crude oil derivatives. The compositions are clean alternative fuels that contain no olefins, aromatics, heavy hydrocarbons, benzene, sulfur, or any products derived from crude oil. The compositions emit fewer hydrocarbons than gasoline, to help states reduce ozone and meet federal ambient air quality standards. Compositions may be prepared that meet all EPA requirements for "clean fuels," yet at the same time utilize current automobile technology with only minor engine modifications. The compositions require little more than presently existing fuel delivery infrastructure and are based on components that result in a blend that is capable of being competitively priced with gasoline. Other features of the present invention will be pointed out in the following description and claims, which disclose the principles of the invention and the best modes which are presently contemplated for carrying them out.

The above and other features and advantages of the present invention will become clear from the following description of the preferred embodiments considered in conjunction with the accompanying drawings.

DETAILED DESCRIPTION OF THE PREFERRED EMBODIMENT

The compositions of the present invention are virtually free of undesirable olefins, aromatics, heavy hydrocarbons, benzene and sulfur, making the fuel compositions very clean burning. The fuel compositions of the present invention may be utilized to fuel conventional spark-ignition internal combustion engines with minor modification. The primary requirement is the lowering of the air/fuel ratio to between about 12 and about 13, as opposed to 14.6, typical of gasoline fueled engines. This adjustment is necessary because of the large quantity of oxygen that is already contained in the fuel.

This adjustment can be accomplished in vehicles manufactured in 1996 and thereafter by software modifications to the on-board engine computer. For older cars, it will be necessary to replace a chip in the on-board engine computer, or, in some cases, to replace the on-board engine computer entirely. Carbureted vehicles, on the other hand, can be readily adjusted to the appropriate air/fuel ratio, and at most will require a simple orifice replacement. Vehicles fueled by the compositions of the present invention preferably should be adapted to run on ethanol or methanol by having fuel system components installed that are compatible with ethanol and methanol, and do not have parts in contact with the fuel made from ethanol and methanol sensitive materials such as nitrile rubber, and the like.

The Clean Air Act Amendments of 1990 set maximum values for both olefins and aromatics, because they result in emission of unburned hydrocarbons. A maximum of 24.6 percent by volume of aromatics may be present in the winter, and 32.0 percent by volume in the summer. A maximum of 11.9 percent by volume of olefins may be present in the winter, and a maximum of 9.2 percent by volume in the summer. Benzene must be present at a level less than or equal to 1.0 percent by volume, and the maximum permitted sulfur is 338 ppm. The fuel compositions of the present invention are essentially free of such materials.

Motor fuel compositions according to the invention are produced by blending one or more hydrocarbons with a fuel grade alcohol selected from methanol, ethanol and mixtures thereof and a co-solvent for the one or more hydrocarbons and the fuel grade alcohol. The fuel grade alcohol is added to increase the anti-knock index of the hydrocarbon component. The co-solvents of the present invention make it possible to add to the motor fuel compositions significant quantifies of alcohol effective to provide an acceptable combination of anti-knock index and DVPE. Suitable fuel grade alcohols can be readily identified and obtained for use in the present invention by one of ordinary skill in the art.

Other anti-knock index increasing additives may be used as well, including those additives, such as toluene, derived from crude oil. However, preferred compositions in accordance with the present invention will be substantially free of crude oil derivatives, including crude oil-derived additives for increasing the anti-knock index.

Essentially any hydrocarbon source containing one or more 5 to 8 carbon atom straight-chained or branched alkanes is suitable for use with the present invention if the hydrocarbon source, as a whole, has a minimum anti-knock index of 65 as measured by ASTM D-2699 and D-2700 and a maximum DVPE of 15 psi as measured by ASTM D-5191. Those of ordinary skill in the art understand the term "anti-knock index" to refer to the average of the Research Octane No. as measured by ASTM D-2699 and the Motor Octane No. as measured by ASTM D-2700. This is commonly expressed as (R+M)/2.

The hydrocarbon component is preferably derived from CGL or NGL's, and is more preferably the NGL's fraction defined by the Gas Processors Association and the ASTM as pentanes plus, which is a commercially available commodity. However, any other hydrocarbon blend having an equivalent energy content, oxygen content and combustion properties may also be used. For example, the fraction of NGL's defined by the Gas Processors Association and the ASTM as "natural gasoline" can be blended with isopentane and substituted for pentanes plus. Natural gasoline alone may be used, as well. In most circumstances, the preparation of blends instead of using "straight" pentanes plus or natural gasoline will be more costly. While any other equivalent blend may be used, similar cost considerations apply.

The hydrocarbon component is blended with the fuel grade alcohol using a co-solvent selected to provide a blend with a DVPE below 15 psi without a sacrifice in the anti-knock index or flash point of the resulting blend, so that a motor fuel composition is obtained suitable for use in a spark ignition engine with minor modifications. Co-solvents suitable for use with the present invention are miscible in both the hydrocarbons and the fuel grade alcohol and have a boiling point high enough to provide a DVPE less than 15 psi in the final blend, preferably greater than 75° C. The co-solvent should have a flash point low enough to ensure cold starting of the final blend, preferably less than −10° C. The co-solvent should also have at least an 85° C. difference between the boiling point and flash point and a specific gravity greater than 0.78.

Five to seven atom heterocyclic ring compounds are preferred as the co-solvent. The heteroatomic polar ring structure is compatible with fuel grade alcohols, yet possesses non-polar regions compatible with hydrocarbons. The heteroatomic structure also functions to depress the vapor pressure of the co-solvent and consequently the resulting blend. The same advantageous properties can also be obtained from short-chained ethers; however, ring compounds are preferred.

Saturated alkyl-branched heterocyclic compounds with a single oxygen atom in the ring are preferred, because the alkyl branching further depresses the vapor pressure of the co-solvent. The ring compound may contain multiple alkyl branches however, a single branch is preferred. MTHF is an example of a five-membered heterocyclic ring with one methyl branch adjacent to the oxygen atom in the ring.

While nitrogen containing ring compounds are included among the co-solvents of the present invention, they are less preferred because the nitrogen heteroatoms form oxides of nitrogen combustion products, which are pollutants. Thus, oxygen-containing heterocyclic ring compounds are preferred over rings with nitrogen heteroatoms, with alkylated ring compounds being more preferred. In addition, the ring oxygen also functions as an oxygenate that promotes cleaner burning of the motor fuel compositions of the present invention. Thus, oxygen-containing heterocyclic ring compounds are particularly preferred co-solvents in the motor fuel compositions of the present invention because of their ability as oxygenates to provide a cleaner burning fuel composition which is in addition to their being a vapor pressure-lowering co-solvent for hydrocarbons and fuel grade alcohols.

Accordingly, oxygen-containing saturated five- to seven atom heterocyclic rings are most preferred. MTHF is particularly preferred. While MTHF is considered an octane depressant for gasoline, it improves the octane rating of NGL's. Not only does MTHF have superior miscibility with hydrocarbons and alcohols and a desirable boiling point, flash point and density, MTHF is a readily available, inexpensive, bulk commodity item. MTHF also has a higher heat content than fuel grade alcohols and does not pick up water as alcohols do, and is thus fungible in an oil pipeline. This permits larger quantities of the fuel grade alcohols to be used to increase the anti-knock index of the motor fuel compositions.

In addition, MTHF is commercially derived from the production of levulenic acid from waste cellulosic biomass such as corn husks, corn cobs, straw, oat/flee hubs, sugar cane stocks, low-grade waste paper, paper mill waste sludge, wood wastes, and the like. The production of MTHF from such cellulosic waste products is disclosed in U.S. Pat. No. 4,897,497. MTHF that has been produced from waste cellulosic biomass is particularly preferred as a co-solvent in the motor fuel compositions of the present invention.

Examples of other suitable co-solvents, selected on the basis of boiling point, flash point, density and miscibility with fuel grade alcohols and pentanes plus, are 2-methyl-2-propanol, 2-buten-2-one, tetrahydropyran, 2-ethyltetrahydrofuran (ETHF), 3,4-dihydro-2H-pyran, 3,3-dimethyloxetane, 2-methylbutyraldehyde, butylethyl ether, 3-methyltetrahydropyran, 4-methyl-2-pentanone, diallyl ether, allyl propyl ether, and the like. As is readily apparent from the above list, short-chained ethers function as well as heterocyclic ring compounds with respect to miscibility with hydrocarbons and fuel grade alcohols and vapor pressure depression of the resulting motor fuel composition. Like the oxygen-containing heterocyclic ring compounds, short-chained ethers are also ideally vapor pressure-lowering oxygenates.

The motor fuel compositions of the present invention optionally include n-butane in an amount effective to provide a DVPE between about 7 and about 15 psi. However, the compositions may be formulated to provide a DVPE as low as 3.5 psi. The higher DVPE is desirable in the northern United States and Europe during winter to promote cold weather starting. Preferably, the n-butane is obtained from NGL's or CGL.

The motor fuel compositions also optionally include conventional additives for spark ignition motor fuels. Thus, the motor fuel compositions of the present invention may include conventional amounts of detergent, anti-foaming, and anti-icing additives and the like. The additives may be derived from crude oil; however, preferred compositions in accordance with the present invention are substantially flee of crude oil derivatives.

The motor fuel compositions of the present invention are prepared using conventional rack-blending techniques for ethanol-containing motor fuels. Preferably, to prevent evaporative loss emissions, the dense co-solvent component is first pumped cold (less than 70° F.) through a port in the bottom of a blending tank. The hydrocarbons are then pumped without agitating through the same port in the bottom of the tank to minimize evaporative loss. If used, n-butane is pumped cold (less than 40° F.) through the bottom of the tank. The butane is pumped next through the bottom port, so it is immediately diluted so that surface vapor pressure is minimized to prevent evaporative losses. Alternatively, two or more of the MTHF, hydrocarbons and n-butane, if used, may be pumped through the bottom port together. If not blended at the distribution rack, the two or three components may be obtained as a blend through conventional gasoline pipelines. Because ethanol alone would otherwise raise the vapor pressure of the hydrocarbons and promote evaporative loss, the ethanol is preferably blended last, after the MTHF and n-butane, if present, has already blended with the hydrocarbon, by conventional splash blending techniques for the introduction of ethanol to motor fuels.

Thus, for a blend containing n-butane, ethanol, MTHF and pentanes plus, the MTHF is first pumped into the blending tank. Without agitation, pentanes-plus is pumped through the bottom of the tank into the MTHF, followed by the n-butane (if used). Finally, ethanol is blended through the bottom. The blend is then recovered and stored by conventional means.

The hydrocarbons, fuel grade alcohol and co-solvent are added in amounts selected to provide a motor fuel composition with a minimum anti-knock index of 87 as measured by ASTM D-2699 and D-2700 and a maximum DVPE of 15 psi as measured by ASTM D-5191. A minimum anti-knock index of 89.0 is preferred, and a minimum anti-knock index of 92.5 is even more preferred. In the summer, a maximum DVPE of 8.1 psi is preferred, with a maximum DVPE of 7.2 psi being more preferred. In the winter, the DVPE should be as close as possible to 15 psi, preferably between about 12 and about 15 psi. For this reason, n-butane may be added to the motor fuel compositions of the present invention in an amount effective to provide a DVPE within this range.

In preferred motor fuel compositions in accordance with the present invention, the hydrocarbon component consists essentially of one or more hydrocarbons obtained from NGL's, blended with ethanol, MTHF and, optionally, n-butane. The NGL's hydrocarbons may be present at a level between about 10 and about 50 percent by volume, the ethanol may be present in an amount between about 25 and about 55 percent by volume, the MTHF may be present in an amount between about 15 and about 55 percent by volume, and the n-butane may be present in a level between zero and about 15 percent by volume. More preferred motor fuel compositions contain from about 25 to about 40 percent by volume of pentanes plus, from about 25 to about 40 percent by volume of ethanol, from about 20 to about 30 percent by volume of MTHF and from zero to about 10 percent by volume of n-butane.

The compositions of the present invention may be formulated as summer and winter fuel blends having T10 and T90 values as measured by ASTM-D86 within ASTM specifications for summer and winter fuel blends. The winter blend compositions of the present invention are significantly more volatile than conventional gasoline to aid cold weather starting. The T90 values indicate the amount of "heavy-end" components in the fuel. These substances are considered to be a primary source of unburned hydrocarbons during the cold start phase of engine operation. The lower values of "heavy-end" components in the compositions of the present invention also indicates superior emissions performance. The amount of solid residue after combustion is only one-fifth that typically found in conventional gasoline.

A particularly preferred summer fuel blend contains about 32.5 percent by volume of pentanes plus, about 35 percent by volume of ethanol, and about 32.5 percent by volume of MTHF. This blend is characterized as follows:

| TEST | METHOD | RESULT | CONDITIONS |
|---|---|---|---|
| API Gravity | ASTM D4052 | 52.1 | 60° F. |
| Distillation | ASTM D86 | | |
| Initial Boiling Point | | 107.0° C. | |
| T10 | | 133.2° F. | |
| T50 | | 161.8° F. | |
| T90 | | 166.9° F. | |
| Final Boiling Point | | 195.5° F. | |
| Recovered | | 99.5 wt. % | |
| Residue | | 0.3 wt. % | |
| Loss | | 0.2 wt. % | |
| DVPE | ASTM D5191 | 8.10 psi | |
| Lead | ASTM D3237 | <0.01 g/gal | |
| Research Octane No. | ASTM D2699 | 96.8 | |
| Motor Octane No. | ASTM D2700 | 82.6 | |
| R + M/2 (Anti-Knock Index) | ASTM D4814 | 89.7 | |
| Copper Corrosion | ASTM D130 | 1A | 3 hrs. @ 122° F. |
| Gum, (After Wash) | ASTM D381 | 2.2 mg/100 mL | |
| Sulfur | ASTM D2622 | 3.0 ppm | |
| Phosphorous | ASTM D3231 | <0.004 g/gal | |
| Oxidation Stability | ASTM D525 | 165 min | |
| Oxygenates | ASTM D4815 | | |
| Ethanol | | 34.87 vol % | |
| Oxygen | ASTM D4815 | 18.92 wt % | |
| Benzene | ASTM D3606 | 0.15 vol % | |
| V/L 20 | CALCULATED | 135° F. | |
| Doctor Test | ASTM D4952 | POSITIVE | |
| Aromatics | ASTM D1319 | .41 vol % | |
| Olefins | ASTM D1319 | 0.09 vol % | |
| Mercaptan Sulfur | ASTM D3227 | .0010 wt % | |
| Water Tolerance | ASTM D4814 | <-65° C. | |
| Heat Content | ASTM D3338 | 18,663 BTU/lb | |

A particularly preferred winter fuel blend contains about 40 percent by volume of pentanes plus, about 25 percent by volume of ethanol, about 25 percent by volume of MTHF and about 10 percent by volume of n-butane. This blend is characterized as follows:

| TEST | METHOD | RESULT | CONDITIONS |
|---|---|---|---|
| API Gravity | ASTM D4052 | 59.0 | 60° F. |
| Distillation | ASTM D86 | | |
| Initial Boiling Point | | 83.7° F. | |
| T10 | | 102.7° F. | |
| T50 | | 154.1° F. | |
| T90 | | 166.5° F. | |
| Final Boiling Point | | 235.6° F. | |
| Recovery | | 97.1 wt. % | |
| Residue | | 1.2 wt. % | |
| Loss | | 2.9 wt. % | |

-continued

| TEST | METHOD | RESULT | CONDITIONS |
|---|---|---|---|
| DVPE | ASTM D5191 | 14.69 psi | |
| Lead | ASTM D3237 | <0.01 g/gal | |
| Research Octane No. | ASTM D2699 | 93.5 | |
| Motor Octane No. | ASTM D2700 | 84.4 | |
| R + M/2 (Anti-Knock Index) | ASTM D4814 | 89.0 | |
| Copper Corrosion | ASTM D130 | 1A | 3 hrs. @ 122° F. |
| Gum, (After Wash) | ASTM D381 | <1 mg/100 mL | |
| Sulfur | ASTM D2622 | 123 ppm | |
| Phosphorous | ASTM D3231 | <0.004 g/gal | |
| Oxidation Stability | ASTM D525 | 105 min | |
| Oxygenates | ASTM D4815 | | |
| Ethanol | | 25.0 vol % | |
| Oxygen | ASTM D4815/ OFID | 9.28 wt % | |
| Benzene | ASTM D3606 | 0.18 vol % | |
| V/L 20 | CALCULATED | 101° F. | |
| Doctor Test | ASTM D4952 | POSITIVE | |
| Aromatics GC-MSD | | 0.51 vol % | |
| Olefins | ASTM D1319 | 2.6 vol % | |
| Mercaptan Sulfur | ASTM D3227 | | |
| Water Tolerance | ASTM D4814 | <-65° C. | |
| Heat Content | ASTM D3338 | 18,776 BTU/lb | |

A preferred summer premium blend contains about 27.5 percent by volume of pentanes plus, about 55 percent by volume of ethanol and about 17.5 percent by volume of MTHF. The blend is characterized as follows:

| TEST | METHOD | RESULT | CONDITIONS |
|---|---|---|---|
| API Gravity | ASTM D4052 | 58.9 | 60° F. |
| Distillation | ASTM D86 | | |
| Initial Boiling Point | | 103.5° F. | |
| T10 | | 128.2° F. | |
| T50 | | 163.7° F. | |
| T90 | | 169.8° F. | |
| Final Boiling Point | | 175.0° F. | |
| Recovered | | 99.0 wt. % | |
| Residue | | 0.6 wt. % | |
| Loss | | 0.4 wt. % | |
| DVPE | ASTM D5191 | 8.05 psi | |
| Lead | ASTM D3237 | <0.01 g/gal | |
| Research Octane No. | ASTM D2699 | 100.5 | |
| Motor Octane No. | ASTM D2700 | 85.4 | |
| R + M/2 (Anti-Knock Index) | ASTM D4814 | 93.0 | |
| Copper Corrosion | ASTM D130 | 1A | 3 hrs. @ 122° F. |
| Gum, (After Wash) | ASTM D381 | 1.6 mg/100 mL | |
| Sulfur | ASTM D2622 | 24 ppm | |
| Phosphorous | ASTM D 3231 | <0.004 g/gal | |
| Oxidation Stability | ASTM D525 | 150 min | |
| Oxygenates | ASTM D4815 | | |
| Ethanol | | 54.96 vol % | |
| Oxygen | ASTM D4815 | 19.98 wt % | |
| Benzene | ASTM D3606 | 0.22 vol % | |
| V/L 20 | CALCULATED | 126° F. | |
| Doctor Test | ASTM D4952 | POSITIVE | |
| Aromatics | ASTM D1319 | 0.20 vol % | |
| Olefins | ASTM D1319 | 0.15 vol % | |
| Mercaptan Sulfur | ASTM D3227 | .0008 wt % | |
| Water Tolerance | ASTM D4814 | <-65° C. | |
| Heat Content | ASTM D3338 | 18,793 BTU/lb | |

A preferred winter premium blend contains about 16 percent by volume of pentanes plus, about 47 percent by volume of ethanol, about 26 percent by volume of MTHF and about 11 percent by volume of n-butane. The blend is characterized as follows:

| TEST | METHOD | RESULT | CONDITIONS |
|---|---|---|---|
| API Gravity | ASTM D4052 | 51.6 | 60° F. |
| Distillation | ASTM D86 | | |
| Initial Boiling Point | | 83.7° F. | |
| T10 | | 109.7° F. | |
| T50 | | 165.2° F. | |
| T90 | | 168.7° F. | |
| Final Boiling Point | | 173.4° F. | |
| Recovery | | 97.9 wt. % | |
| Residue | | | |
| Loss | | 2.1 wt. % | |
| DVPE | ASTM D5191 | 14.61 psi | |
| Lead | ASTM D3237 | <0.01 g/gal | |
| Research Octane No. | ASTM D2699 | 101.2 | |
| Motor Octane No. | ASTM D2700 | 85.4 | |
| R + M/2 (Anti-Knock Index) | ASTM D4814 | 93.3 | |
| Copper Corrosion | ASTM D130 | 1A | 3 hrs. @ 122° F. |
| Gum, (After Wash) | ASTM D381 | <1 mg/100 mL | |
| Sulfur | ASTM D2622 | 111 ppm | |
| Phosphorous | ASTM D3231 | <0.004 g/gal | |
| Oxidation Stability | ASTM D525 | 210 min | |
| Oxygenates | ASTM D4815 | | |
| Ethanol | | 47.0 vol % | |
| Oxygen | ASTM D4815/ OFID | 16.77 wt % | |
| Benzene | ASTM D3606 | 0.04 vol % | |
| V/L 20 | CALCULATED | | |
| Doctor Test | ASTM D4952 | POSITIVE | |
| Aromatics | GC-MSD | 0.17 vol % | |
| Olefins | ASTM D1319 | 0.85 vol % | |
| Mercaptan Sulfur | ASTM D3227 | | |
| Water Tolerance | ASTM D4814 | <-65° C. | |
| Heat Content | ASTM D3338 | 18,673 BTU/lb | |

Thus, it will be appreciated that the present invention provides a motor gasoline alternative essentially free of crude oil products that can fuel a spark ignition internal combustion engine with minor modifications, yet can be blended to limit emissions resulting from evaporative losses. The present invention provides fuel compositions containing less than 0.1 percent benzene, less than 0.5 percent aromatics, less than 0.1 percent olefins and less than 10 ppm sulfur. The following examples further illustrate the present invention, and are not to be construed as limiting the scope thereof. All parts and percentages are by volume unless expressly indicated to be otherwise and all temperatures are in degrees Fahrenheit.

EXAMPLE I

A fuel composition in accordance with the present invention was prepared by blending 40 percent by volume of natural gasoline procured from Daylight Engineering, Elberfield, Ind., 40 percent by volume of 200 proof ethanol procured from Pharmco Products, Inc., Brookfield, Conn., and 20 percent by volume of MTHF purchased from the Quaker Oats Chemical Company, West Lafayette, Ind. 2 liters of ethanol was pre-blended with 1 liter of MTHF in order to avoid evaporative loss of the ethanol upon contact with the natural gasoline. The ethanol and MTHF were cooled to 40 ° F. prior to blending to further minimize evaporative losses.

2 liters of the natural gasoline was added to a mixing tank. The natural gasoline was also cooled to 40 ° F. to minimize evaporative losses. The blend of ethanol and MTHF was then added to the natural gasoline with mixing. The mixture was gently stirred for 5 seconds until a uniform, homogeneous blend was obtained.

The content of the natural gasoline was analyzed by Inchcape Testing Services (Caleb-Brett) of Linden, N.J. It was found to consist of the following components:

| | |
|---|---|
| Butane | Not Found |
| Isopentane | 33 Vol. % |
| n-Pentane | 21 Vol. % |
| Isohexane | 26 Vol. % |
| n-Hexane | 11 Vol. % |
| Isoheptane | 6 Vol. % |
| n-Heptane | 2 Vol. % |
| Benzene | <1 Vol. % |
| Toluene | <0.5 Vol. % |

Thus, while Daylight Engineering refers to this product as "natural gasoline," the product conforms to the Gas Processor's Association's definition of pentanes plus, as well as the definition of pentanes plus for purposes of the present invention.

The motor fuel was tested on a 1984 Chevrolet Caprice Classic with a 350 CID V-8 engine and a four barrel carburetor (VIN 1G1AN69H4EX149195). A carbureted engine was chosen so that adjustment of the idle fuel mixture was possible without electronic intervention. There was a degree of electronic fuel management in that the oxygen content in the exhaust, manifold air pressure, throttle position and coolant temperature were measured. Pollution tests were performed at two throttle positions, fast-idle (1950 rpm) and slow-idle (720 rpm). THC (total hydrocarbons), CO (carbon monoxide), $O_2$ and $CO_2$ exhaust emissions were recorded with a wand-type four-gas analyzer.

The engine was examined and a broken vacuum line was replaced. The idle-speed and spark timing were adjusted to manufacturer's specifications. The ignition "spark line" appeared to be even, indicating no undue problem with any of the spark plugs or wires. The manifold vacuum was between 20 and 21 inches and steady, indicating no difficulties with the piston rings or intake and exhaust valves.

At the time this test was performed in the New York Metropolitan area, conventional gasoline was not available at retail. Therefore, the comparison was not made with a "base line gasoline" as defined in the Clean Air Act, but with a fuel already formulated to burn more cleanly. The emissions tests performed on the above fuel composition were compared to SUNOCO 87-octane reformulated gasoline purchased at a retail service station. Tests were performed on the same engine, on the same day, and within one hour of each other. The three tests included: (1) fast and slow idle emissions tests for total hydrocarbons (THC) and carbon monoxide (CO), (2) fast-idle fuel consumption, and (3) 2.7 mile road test for fuel economy and driveability. The summary of the emissions tests is shown in the following table:

| Time Of Day | Idle Speed (rpm) | Fuel | THC (ppm) | CO (%) |
|---|---|---|---|---|
| 09:46 | 720 | Sunoco-87 | 132 | 0.38 |
| 09:54 | 720 | Sunoco-87 | 101 | 0.27 |
| 09:55 | 1950 | Sunoco-87 | 132 | 0.61 |
| 10:42 | 700 | NGL's/ethanol | 76 | 0.03 |
| 10:44 | 720 | NGL's/ethanol | 65 | 0.02 |
| 10:48 | 1900 | NGL's/ethanol | 98 | 0.01 |

It should be noted that the New Jersey state emissions requirements for model years 1981 to the present are THC<220 ppm and CO<1.2 percent.

The engines were operated at fast idle (1970 rpm) for approximately 7 minutes. Fuel consumption for the above fuel composition was 650 mL in 6 minutes and 30 seconds (100 mL per minute). The fuel consumption for the reformulated gasoline was 600 mL in 7 minutes (86 mL per minute). The 2.7 mile on-road test showed no significant difference in fuel consumption (900 mL for the above fuel composition and 870 mL for the reformulated gasoline).

Compared with the reformulated gasoline, the above fuel composition reduced CO emissions by a factor of 10, and THC emissions decreased by 43 percent. In the fast-idle test, the consumption of the above fuel composition was 14 percent greater than the reformulated gasoline. No significant difference in driveability was noticed during the on-road test. During full-throttle acceleration, engine knock was slightly more noticeable with the reformulated gasoline.

Thus, it will be appreciated that the fuel compositions of the present invention can be used to fuel spark-ignited internal combustion engines. The CO and THC emission properties are better than gasoline reformulated to burn cleaner than baseline gasoline, with no significant difference in fuel consumption.

EXAMPLE II

A summer fuel blend was prepared as in Example I, containing 32.5 percent by volume of natural gasoline (Daylight Engineering), 35 percent by volume of ethanol and 32.5 percent by volume of MTHF. A winter fuel blend was prepared as in Example I, containing 40 percent by volume of pentanes plus, 25 percent by volume of ethanol, 25 percent by volume of MTHF and 10 percent by volume of n-butane. The motor fuels were tested along with $E_D85$ (E85), a prior art alternative fuel containing 80 percent by volume of 200 proof pure ethyl alcohol and 20 percent by volume of indolene, an EPA certification test fuel defined in 40 C.F.R. § 86 and obtained from Sunoco of Marcus Hook, Pa. The E85 was prepared according to the method disclosed in Example I. The three fuels were tested against indolene as a control on a 1996 Ford Taurus GL sedan ethanol Flexible Fuel Vehicle (VIN 1FALT522XSG195580) with a fully warmed-up engine. Emissions testing was performed at Compliance and Research Services, Inc. of Linden, N.J.

The vehicle was loaded on a Clayton Industries, Inc., Model ECE-50 (split roll) dynamometer. The dynamometer was set for an inertial test weight of 3,750 lbs. The exhaust gases were sampled with a Horiba Instruments, Inc. Model CVS-40 gas analyzer. Hydrocarbons (THC) were analyzed with a Horiba Model FIA-23A Flame Ionization Detector (FID). Carbon Monoxide (CO) and Carbon Dioxide ($CO_2$) were analyzed with a Horiba Model AIA-23 Non-Dispersive Infrared Detector (NDIR). Hydrocarbon speciation was performed on a Gas Chromatograph with a FID manufactured by Perkin Elmer Inc. The GC column was a Supelco 100M×0.25 mm×0.50 micron Petrocol DH. All emissions testing equipment was manufactured in 1984.

The summary of emissions sampled directly from the exhaust manifold (before the catalytic converter) are shown in the following table as the percentage reduction of THC and CO for each fuel blend relative to indolene:

| ENGINE | | WINTER | | SUMMER | | E85 | |
|---|---|---|---|---|---|---|---|
| SPEED | MPH | THC | CO | THC | CO | THC | CO |
| 1500 | 30 | −27 ± 23 | n.s. | −45 ± 25 | n.s. | −42 ± 23 | n.s. |
| 2000 | 41 | −35 ± 23 | n.s. | −47 ± 31 | n.s. | −45 ± 29 | n.s. |
| 2500 | 51 | −37 ± 10 | n.s. | −53 ± 11 | n.s. | −43 ± 11 | n.s. |
| 3000 | 61 | −65 ± 18 | −71 ± 18 | −68 ± 14 | −73 ± 13 | −50 ± 20 | −48 ± 23 |
| 3500 | 67 | −71 ± 21 | −71 ± 46 | −74 ± 21 | −76 ± 47 | −54 ± 18 | −46 ± 41 |

n.s. = no significant variation

The fuel compositions burned essentially the same as indolene at lower engine rpm's, but significantly better at rpm's of 2500 and greater. In most cases the fuels burned as clean as or cleaner than E85.

The essential feature of the Ford Taurus Flexible Fuel Vehicle was its ability to choose the proper air/fuel ratio for any mixture of fuels used. The vehicle was not modified externally in any way between tests. The Electronic Emissions Computer and fuel sensor showed that the selected air/fuel ratio was as follows:

| | |
|---|---|
| indolene | 14.6 |
| winter blend | 12.5 |
| summer blend | 11.9 |
| E85 | 10.4 |

The foregoing examples and description of the preferred embodiment should be taken as illustrating, rather than as limiting, the present invention as defined by the claims. As will be readily appreciated, numerous variations and combinations of the features set forth above can be utilized without departing from the present invention as set forth in the claims. All such modifications are intended to be included within the scope of the following claims.

What is claimed is:

1. A spark ignition motor fuel composition consisting essentially of:

a hydrocarbon component consisting essentially of a mixture of five to seven carbon atom straight-chained or branched alkanes essentially free of olefins, aromatics and sulfur present in an amount between about 10 and about 50 percent by volume of said motor fuel composition, wherein said hydrocarbon component has a minimum anti-knock index of 65 as measured by ASTM D-2699 and D-2700 and a maximum Dry Vapor Pressure Equivalent of 15 psi as measured by ASTM D-5191, and optionally including n-butane in an amount up to about 15 percent by volume of said motor fuel composition;

ethanol, present in an amount between about 25 and about 55 percent by volume of said motor fuel composition; and 2-methyltetrahydrofuran, present in an amount between about 15 and about 55 percent by volume of said motor fuel composition.

2. The spark ignition motor fuel composition of claim 1, consisting essentially of:

from about 25 to about 40 percent by volume of said hydrocarbon compound;

from about 25 to about 40 percent by volume of ethanol;

from about 20 to about 35 percent by volume of 2-methyltetrahydrofuran; and optionally including up to about 10 percent by volume of n-butane.

3. The motor fuel composition of claim 2, consisting essentially of about 32.5 percent by volume of said hydrocarbon component, about 35 percent by volume of ethanol and about 32.5 percent by volume of 2-methyltetrahydrofuran, and having a Dry Vapor Pressure Equivalent of about 8.3 psi as measured by ASTM D-5191 and an anti-knock index of about 89.7 as measured by ASTM D-2699 and D-2700.

4. The motor fuel composition of claim 2, consisting essentially of about 40 percent by volume of said hydrocarbon component, about 25 percent by volume of ethanol, about 25 percent by volume of 2-methyltetrahydrofuran and about 10 percent by volume of n-butane, and having a Dry Vapor Pressure Equivalent of about 14.7 psi as measured by ASTM D-5191 and an anti-knock index of about 89.0 as measured by ASTM D-2699 and D-2700.

5. The motor fuel composition of claim 1, consisting essentially of about 27.5 percent by volume of said hydrocarbon component, about 55 percent by volume of ethanol and about 17.5 percent by volume of 2-methyltetrahydrofuran, and having a Dry Vapor Pressure Equivalent of about 8.0 psi as measured by ASTM D-5191 and an anti-knock index of about 93.0 as measured by ASTM D-2699 and D-2700.

6. The motor fuel composition of claim 1, consisting essentially of about 16 percent by volume of said hydrocarbon component, about 47 percent by volume of ethanol, about 26 percent by volume of 2-methyltetrahydrofuran and about 11 percent by volume of n-butane, and having a Dry Vapor Pressure Equivalent of about 14.6 psi as measured by ASTM D-5191 and an anti-knock index of about 93.3 as measured by ASTM D-2699 and D-2700.

7. The motor fuel composition of claim 1, consisting essentially of about 40 percent by volume of said hydrocarbon component, about 40 percent by volume of ethanol and about 20 percent by volume of 2-methyltetrahydrofuran.

8. The motor fuel composition of claim 7, wherein said hydrocarbon component, said ethanol and said 2-methyltetrahydrofuran are present in amounts effective to provide a motor fuel with a minimum anti-knock index of 89.0 as measured by ASTM D-2699 and ASTM D-2700.

9. The motor fuel composition of claim 8, wherein said hydrocarbon component, said ethanol and said 2-methyltetrahydrofuran are present in amounts effective to provide a motor fuel with a minimum anti-knock index of 92.5 as measured by ASTM D-2699 and ASTM D-2700.

10. The motor fuel composition of claim 1, wherein said hydrocarbon compound, said ethanol and said 2-methyltetrahydrofuran are present in amounts effective to provide a motor fuel with a maximum DVPE of 8.3 psi as measured by ASTM D-5191.

11. The motor fuel composition of claim 1, wherein said hydrocarbon component, said ethanol and said 2-methyltetrahydrofuran are present in amounts effective to provide a motor fuel with a DVPE between about 12 and about 15 psi as measured by ASTM D-5191.

12. The spark ignition motor fuel of claim 1, wherein said hydrocarbon component is obtained from Natural Gas Liquids.

13. The spark ignition motor fuel of claim 1, wherein said hydrocarbon component comprises pentanes plus.

14. A method for lowering the vapor pressure of a hydrocarbon-ethanol blend comprising blending between about 25 and about 55 percent by volume of ethanol and between about 10 and about 50 percent by volume of a hydrocarbon component consisting essentially of a mixture of five to seven carbon atom straight-chained or branched alkanes essentially free of olefins, aromatics and sulfur, and having a minimum anti-knock index of 65 as measured by ASTM D-2699 and D-2700 and a maximum Dry Vapor Pressure Equivalent of 15 psi as measured by ASTM D-5191, with an amount of 2-methyltetrahydrofuran between about 15 and about 55 percent by volume, so that a ternary blend is obtained having a Dry Vapor Pressure Equivalent as measured by ASTM D-5191 lower than the Dry Vapor Pressure Equivalent for a binary blend of said ethanol and said hydrocarbon obtained from Natural Gas Liquids.

15. The method of claim 14, wherein said ethanol, said hydrocarbons and said 2-methyltetrahydrofuran are present in amounts effective to provide a motor fuel with a minimum anti-knock index of 87 as measured by ASTM D-2699 and D-2700, and a maximum Dry Vapor Pressure Equivalent of 15 psi.

16. The method of claim 14, wherein said hydrocarbons and said 2-methyltetrahydrofuran are pre-blended together before being blended with said ethanol.

* * * * *

UNITED STATES PATENT AND TRADEMARK OFFICE

CERTIFICATE OF CORRECTION

PATENT NO. : 5,697,987

DATED : December 16, 1997

INVENTOR(S) : Stephen F. Paul

It is certified that error appears in the above-identified patent and that said Letters Patent is hereby corrected as shown below:

On the title page, under "[73] Assignee:" "Princetion" should read --Princeton--.

Column 6, line 36, "oat/flee hubs" should read --oat/rice hulls--.

Column 7, line 5, "flee" should read --free--.

Column 13, line 62 (line 4 of claim 2), "compound" should read --component--.

Column 14, line 48 (line 1 of claim 8), "claim 7" should read --claim 1--.

Column 16, line 4 (next to last line of claim 14), "hydrocarbon" should read --hydrocarbons--.

Signed and Sealed this

Tenth Day of March, 1998

*Attest:*

*Attesting Officer*

BRUCE LEHMAN

*Commissioner of Patents and Trademarks*